US009829244B2

(12) United States Patent
Mak

(10) Patent No.: US 9,829,244 B2
(45) Date of Patent: Nov. 28, 2017

(54) CONFIGURATIONS AND METHODS FOR SMALL SCALE LNG PRODUCTION

(75) Inventor: John Mak, Santa Ana, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 695 days.

(21) Appl. No.: 13/813,036

(22) PCT Filed: Jul. 29, 2011

(86) PCT No.: PCT/US2011/045937

§ 371 (c)(1),
(2), (4) Date: Apr. 8, 2013

(87) PCT Pub. No.: WO2012/016166

PCT Pub. Date: Feb. 2, 2012

(65) Prior Publication Data

US 2013/0192297 A1 Aug. 1, 2013

Related U.S. Application Data

(60) Provisional application No. 61/368,900, filed on Jul. 29, 2010.

(51) Int. Cl.
*F25J 1/00* (2006.01)
*F25J 1/02* (2006.01)
(Continued)

(52) U.S. Cl.
CPC ..... *F25J 1/0022* (2013.01); *F17C 6/00* (2013.01); *F17C 9/00* (2013.01); *F17C 13/025* (2013.01);
(Continued)

(58) Field of Classification Search
CPC .... F25J 1/0025; F25J 2210/90; F25J 2245/90; F17C 2265/03; F17C 2265/031;
(Continued)

(56) References Cited

U.S. PATENT DOCUMENTS 3,690,115 A 9/1972 Clayton
3,792,590 A * 2/1974 Lofredo ..... F25J 1/0022 62/47.1

(Continued)

FOREIGN PATENT DOCUMENTS

AU WO 2009006693 A1 * 1/2009 ..... F25J 1/0022
AU 2011282529 3/2014

(Continued)

OTHER PUBLICATIONS

PCT Search Report for PCT/US2011/045937 filed Jul. 29, 2011 mailed on Jan. 9, 2012.

(Continued)

*Primary Examiner* — Frantz Jules
*Assistant Examiner* — Brian King
(74) *Attorney, Agent, or Firm* — Conley Rose, P.C.

(57) ABSTRACT

A small scale natural gas liquefaction plant is integrated with an LNG loading facility in which natural gas is liquefied using a multi-stage gas expansion cycle. LNG is then loaded onto an LNG truck or other LNG transport vehicle at the loading facility using a differential pressure control system that uses compressed boil off gas as a motive force to move the LNG from the LNG storage tank to the LNG truck so as to avoid the use of an LNG pump and associated equipment as well as to avoid venting of boil off vapors into the environment.

9 Claims, 2 Drawing Sheets

(51) Int. Cl.
*F17C 9/00* (2006.01)
*F17C 13/02* (2006.01)
*F17C 6/00* (2006.01)

(52) U.S. Cl.
CPC ..... *F25J 1/004* (2013.01); *F25J 1/005* (2013.01); *F25J 1/007* (2013.01); *F25J 1/0072* (2013.01); *F25J 1/0208* (2013.01); *F25J 1/0288* (2013.01); *F25J 1/0292* (2013.01); *F17C 2205/0326* (2013.01); *F17C 2205/0338* (2013.01); *F17C 2205/0364* (2013.01); *F17C 2205/0367* (2013.01); *F17C 2221/033* (2013.01); *F17C 2223/0161* (2013.01); *F17C 2223/033* (2013.01); *F17C 2223/047* (2013.01); *F17C 2225/0161* (2013.01); *F17C 2225/033* (2013.01); *F17C 2227/0107* (2013.01); *F17C 2250/032* (2013.01); *F17C 2250/0408* (2013.01); *F17C 2250/0434* (2013.01); *F17C 2250/0491* (2013.01); *F17C 2250/0626* (2013.01); *F17C 2260/035* (2013.01); *F17C 2265/032* (2013.01); *F17C 2265/061* (2013.01); *F17C 2270/0139* (2013.01); *F25J 2245/90* (2013.01); *F25J 2270/16* (2013.01); *F25J 2290/62* (2013.01)

(58) Field of Classification Search
CPC ..... F17C 2265/032; F17C 2265/033; F17C 2265/034; F17C 2265/305; F17C 2265/036; F17C 2265/037; F17C 2265/038
See application file for complete search history.

(56) References Cited

U.S. PATENT DOCUMENTS

| | | | | |
|---|---|---|---|---|
| 3,797,514 | A | 3/1974 | Byers et al. | |
| 5,036,671 | A * | 8/1991 | Nelson | F25J 1/0022 62/48.2 |
| 5,322,092 | A | 6/1994 | Howeth et al. | |
| 5,363,655 | A | 11/1994 | Kikkawa et al. | |
| 5,755,114 | A | 5/1998 | Fogliella | |
| 6,237,347 | B1 * | 5/2001 | Rigby | F17C 5/02 137/2 |
| 7,493,778 | B2 * | 2/2009 | Engdahl | F17C 5/06 62/48.2 |
| 7,673,476 | B2 | 3/2010 | Whitesell | |
| 7,690,365 | B2 | 4/2010 | Lee | |
| 7,921,656 | B2 | 4/2011 | Mostello | |
| 2006/0053806 | A1 | 3/2006 | Tassel | |
| 2007/0125122 | A1 * | 6/2007 | Mak | F17C 3/00 62/620 |
| 2007/0256450 | A1 * | 11/2007 | Mostello | F25J 1/0025 62/612 |
| 2008/0034769 | A1 | 2/2008 | Engdahl | |
| 2009/0277219 | A1 | 11/2009 | Mak et al. | |
| 2010/0139317 | A1 | 6/2010 | Chantant | |

FOREIGN PATENT DOCUMENTS

| | | | |
|---|---|---|---|
| CA | 2806688 | C | 7/2015 |
| CN | ZL201180046944.7 | | 3/2016 |
| WO | 9859205 | | 12/1998 |
| WO | 2006118458 | A1 | 11/2006 |
| WO | 2009006695 | | 1/2009 |
| WO | 2009057179 | | 5/2009 |
| WO | 2009126604 | | 10/2009 |
| WO | 2012016166 | A | 2/2012 |
| ZA | 201300736 | | 11/2015 |

OTHER PUBLICATIONS

PCT Written Opinion for PCT/US2011/045937 filed Jul. 29, 2011 mailed on Jan. 9, 2012.
International Application No. PCT/US2011/049537, International Preliminary Report on Patentability, dated Jan. 29 2013, 5 pages.
Australia Patent Application No. 2011282529, Examination Report, dated Jul. 22, 2013, 3 pages.
Australia Patent Application No. 2011282529, Notice of Acceptance, dated Nov. 8, 2013, 5 pages.
Europe Patent Application No. 11813263, Partial European Search Report, Oct. 14, 2016, 7 pages.
Walther, S. et al. "Liquefaction solutions for challenge of offshore FPSO developments", LNG Journal, Nelton Publications, Gravesend, GB, vol. 39, dated Feb. 1, 2008, pp. 31-34.
Canada Patent Application No. 2806688, Office Action, dated Jan. 9, 2014, 2 pages.
Canada Patent Application No. 2806688, Notice of Allowance, dated Nov. 26, 2014, 1 page.
Eurasia Patent Application No. 201390187, Office Action, dated Dec. 11, 2014, 4 pages.
Eurasia Patent Application No. 201390187, Office Action, dated Dec. 10, 2015, 4 pages.
Eurasia Patent Application No. 201390187, Notice of Allowance, dated Jun. 18, 2016, 8 pages.
China Patent Application No. 201180046944, Office Action, dated Oct. 20, 2014, 12 pages.
China Patent Application No. 201180046944, Office Action, dated Jun. 30, 2015, 7 pages.
China Patent Application No. 201180046944, Notification to Grant Patent Right, dated Dec. 4, 2015, 6 pages.
Europe Patent Application No. 11813263, Extended European Search Report, dated Mar. 17, 2017, 14 pages.

* cited by examiner

CONFIGURATIONS AND METHODS FOR SMALL SCALE LNG PRODUCTION

This application claims priority to our U.S. provisional application with the Ser. No. 61/368,900, which was filed Jul. 29, 2010.

FIELD OF THE INVENTION

The field of the invention is natural gas liquefaction and LNG (liquefied natural gas) truck loading, and especially use of gas expansion processes for small scale LNG plants and integration of natural gas liquefaction with an LNG truck loading facility.

BACKGROUND OF THE INVENTION

Natural gas supply in North America is continually growing, mostly due to production of new shale gas, recent discoveries of offshore gas fields, and to a lesser extent, stranded natural gas brought to market after construction of the Alaska natural gas pipeline, and it is believed that shale gas and coal-bed methane will make up the majority of the future growth in the energy market.

While natural gas supply is increasing, crude oil supply is depleting as there are no significant new discoveries of oil reserves. If this trend were to continue, transportation fuel derived from crude oil will soon become cost prohibitive, and alternate renewable fuels (and particularly transportation fuels) are needed. Moreover, since combustion of natural gas also produces significantly less CO2 as compared to other fossil materials (e.g., coal or gasoline), use of natural gas is even more desirable. Natural gas used for transportation fuel must be in a denser form, either as CNG (compressed natural gas) or LNG. CNG is produced by compression of natural gas to very high pressures of about 3000 to 4000 psig. However, even at such pressures, the density of CNG is relatively low and storage at high pressure requires heavy weight vessels and is a potential hazard. On the other hand, LNG has a significantly higher density and can be stored at relatively low pressures of about 20 to 150 psig. Still further, LNG is a safer fuel than CNG as it is at lower pressure and not combustible until it is vaporized and mixed with air in the proper ratio. Nevertheless, CNG is more common than LNG as a transportation fuel, mainly due to the high cost of liquefaction and the lack of infrastructure to support LNG fueling facilities.

LNG can be used to replace diesel and is presently used in many heavy duty vehicles, including refuse haulers, grocery delivery trucks, transit buses, and coal miner lifters. To increase the LNG fuel markets, small scale LNG plants must be constructed close to both pipelines and LNG consumers as long distance transfer of LNG is costly and therefore often not economical. Such small scale LNG plants should be designed to produce 30 tons to 130 tons per day of LNG by liquefying 2 to 10 MMscfd pipeline gas. Moreover, such small scale LNG plants must be simple in design, easy to operate, and sufficiently robust to support an unmanned operation. Still further, it would be desirable to integrate liquefaction with LNG truck fueling operations to allow for even greater delivery flexibility.

Various refrigeration processes are known in the art for LNG liquefaction. The most common of these refrigeration processes are the cascade process, the mixed refrigerant process, and the propane pre-cooled mixed refrigerant process. While these known methods are very energy efficient, such methods are often complex and require circulating several hydrocarbon refrigerants or mixed hydrocarbon refrigerants. Unfortunately, such refrigerants (e.g., propane, ethylene, and propylene) are explosive and hazardous in the event of leakage.

There are several recent innovations in LNG plant design. For example, U.S. Pat. No. 5,755,114 to Foglietta teaches a hybrid liquefaction cycle which includes a closed loop propane refrigeration cycle and a turboexpander cycle. Compared to conventional liquefaction processes, this process has been simplified, but is still unsuitable and/or economically unattractive for small scale LNG plants. U.S. Pat. No. 7,673,476 to Whitesell discloses a compact and modular liquefaction system that requires no external refrigeration. The system uses gas expansion by recycling feed gas to generate cooling. While this design is relatively compact, operation of the recycle system is complicated and the use of hydrocarbon gas for cooling remains a safety concern. U.S. Pat. No. 5,363,655 to Kikkawa teaches the use of gas expander and plate and fin heat exchangers for LNG liquefaction. While providing several advantages, such process is still too complex and costly for small scale LNG plants.

Further compounding the above noted drawbacks is the fact that most of the known systems lack the capability for integration of a small scale LNG plant with an LNG loading operation. Thus, the current practice for loading an LNG truck generally requires an LNG pump to pump the LNG from the storage tanks to the LNG trucks. Remarkably, the boil off vapors generated during the LNG truck loading operation are vented to the atmosphere which is a safety hazard and creates emission pollution.

Thus, while all or almost all of the known configurations and methods provide some advantages over previously known configurations, various disadvantages remain. Among other things, most of the known LNG liquefaction methods and configurations are complex and costly and hence unsuitable for the small scale LNG plants. In addition, most known plants lack an integrated system for LNG loading operations, which is highly desirable for small scale LNG plants.

SUMMARY OF THE INVENTION

The present inventive subject matter is directed to various configurations and methods for small scale LNG plants that are integrated with an LNG loading facility. Most preferably, natural gas (e.g., delivered from a pipeline) is liquefied in a cold box using a gas expansion cycle that employs a two-stage compressor to so produce at least two pressure level gases. The so produced gases are then cooled and expanded to a lower pressure to thereby generate refrigeration prior to mixing in a heat exchanger as a single gas stream that is then fed to the compressors that are driven by the expanders. It is further especially preferred that the LNG loading facility has a pressure control system that uses high pressure feed gas as a motive force to move the LNG product from an LNG storage tank to an LNG truck while boil-off vapors from the LNG truck are recovered in the liquefaction plant.

In one especially preferred aspect, a small scale LNG plant has an integrated loading terminal, wherein the plant includes a cold box with a closed refrigeration cycle (preferably a two stage expander refrigeration system, operating with a non-hydrocarbon refrigerant) to so provide refrigeration content to a natural gas feed at a temperature sufficient to produce LNG from the natural gas feed. It is generally preferred that an LNG storage tank is thermally coupled to the refrigeration cycle to receive and store the LNG, and that a first boil off vapor line provides a first boil off vapor from an LNG transporter to the cold box, and from the cold box to the LNG storage tank, while a second boil off vapor line provides a second boil off vapor from the LNG storage tank to the cold box, and from the cold box to the natural gas feed. Most typically, a compressor compresses at least one of the first and second boil off vapors, and/or a differential pressure controller maintains a predetermined pressure differential (e.g., 5-200 psi, more typically 10-50 psi) between the LNG storage tank and the LNG transporter.

In another especially preferred aspect, LNG from the storage tank is unloaded from the top of the storage tank using an internal pipe in the storage tank, which eliminates the potential hazards of LNG spillage of the LNG tank inventory typically used in commonly used tank configurations.

Therefore, and viewed from a different perspective, a method of liquefying natural gas and loading the LNG to an LNG transporter will include a step of liquefying natural gas feed in a cold box using a closed refrigeration cycle, and feeding the LNG to an LNG storage tank. In another step, a first boil off vapor from an LNG transporter is cooled and compressed, and used as a motive force to deliver LNG from the LNG storage tank to the LNG transporter. In such methods, it is especially preferred that a second boil off vapor from the LNG storage tank is cooled and compressed, and moved from the cold box to the natural gas feed. As before, it is generally preferred that the step of liquefying a natural gas feed is performed using a two stage closed refrigeration cycle, typically using a non-hydrocarbon refrigerant.

Various objects, features, aspects and advantages of the present invention will become more apparent from the following detailed description of preferred embodiments of the invention along with the accompanying drawing.

DETAILED DESCRIPTION

The inventor discovered that a small scale LNG plant can be integrated with an LNG truck loading facility in a conceptually simple and cost-effective manner. In preferred aspects the small scale LNG plant has a capacity of typically between 10 to 200 tons, more typically between 20-80 tons, and most typically between 30 to 130 tons of LNG production per day by liquefaction of appropriate quantities of feed gas. For example, a small scale LNG plant with a capacity between 30 to 130 tons of LNG production per day will require between about 2 to 10 MMscfd of feed gas. In further particularly preferred aspects, the refrigeration process uses a non-hydrocarbon refrigerant (e.g., nitrogen, air, etc.) in a compression expansion cycle to so avoid the safety issues commonly associated with a hydrocarbon refrigeration system.

Figure 1:
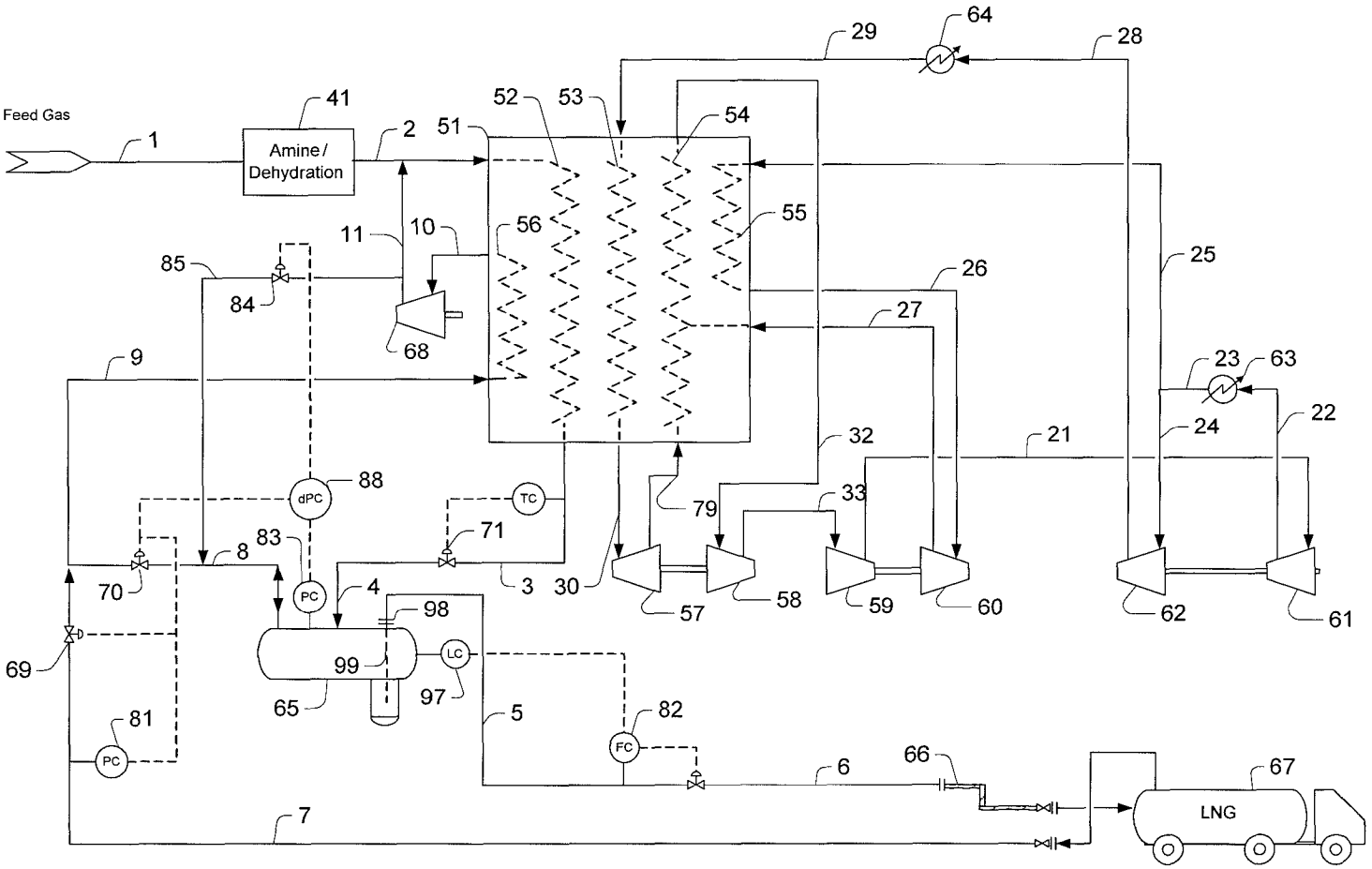
FIG. 1 is one exemplary configuration according to the inventive subject matter.

The following description and FIG. 1 exemplarily illustrates various aspects of the inventive subject matter presented herein. Feed gas stream 1 is supplied to the small scale LNG liquefaction plant at a flow rate of 1.7 MMscfd at 100° F. and 453 psia with the following composition: 1.0 mol % N2, 0.1 mol % CO2, 96.5 mol % methane, 2 mol % ethane, and 0.5 mol % propane and heavier components. The gas is treated in a gas treatment unit 41 that typically includes an amine unit and a molecular sieve dehydration unit for removal of CO2 and water, forming a dried gas stream 2 which is dry and CO2 free. The dried gas stream 2 is combined with the recycle gas stream 11 and enters the cold box 51 which typically comprises at least five heat exchanger passes, 52, 53, 54, 55, and 56. The feed gas is chilled by nitrogen refrigeration in heat exchanger pass 52 forming a sub-cooled stream 3 at −223° F., which is then letdown in pressure in JT valve 71 forming stream 4. The flashed liquid at −227° F. is stored in storage tank 65 operating at 60 psia. The flashed gas stream 8 is recovered by recycling back to the exchanger pass 56 via valve 70. The refrigeration content of this recycle stream 9 is recovered in the cold box 51. Thus, it should be noted that the flashed stream 8 from the storage tank 65 is heated in the cold box 51. Stream 10 exiting the cold box 51 is compressed by compressor 68 to feed gas pressure forming recycle gas stream 11 prior to mixing with dried gas stream 2.

The feed gas stream 2 is liquefied using two nitrogen expanders (57 and 60) and two nitrogen compressors (61 and 62). Nitrogen or air can be used in this cycle as long as the gas is dry. The hydrocarbon content is monitored as known in the art to detect any leakages and the unit can immediately shutdown during emergency.

Figure 2:
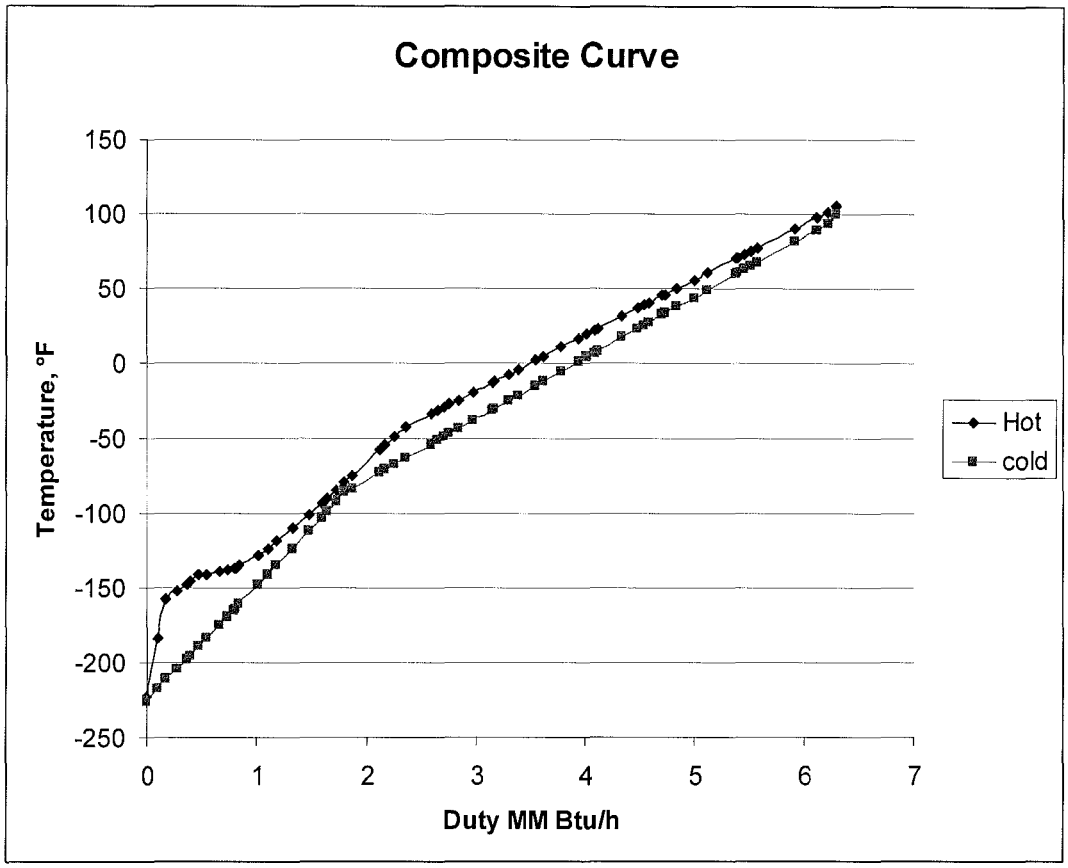
FIG. 2 is an exemplary graph illustrating the close temperature approach of the heat composite curves between the feed gas and the refrigeration circuit.

Stream 21 (31 MMscfd), from compressor 59 (coupled to expander 60) is fed to the nitrogen compressor 61 at 207 psia and 105° F. and is compressed to 260 psia, forming stream 22. The compressor discharge is cooled in ambient cooler 63 forming stream 23 that is split into two portions: stream 24 and 25. The split ratio of stream 24 to 23 is typically 50% to 50%, but it can vary from 25% to 70% depending on the feed gas composition and pressure. Stream 25 is cooled in heat exchanger pass 55 to about −42° F. forming stream 26, which is expanded to 169 psia in expander 60. The first expanded gas stream 27 is chilled to −85° F. which is routed to the mid section of the heat exchanger pass 54 to mix with the second expanded gas stream 79. Stream 24 is further compressed by nitrogen compressor 62 to 410 psia to form stream 28, cooled by ambient cooler 64 forming stream 29 and fed to heat exchanger pass 53. The high pressure nitrogen stream 29 is chilled to −158° F. forming stream 30, which is expanded to 169 psia by expander 57, forming the second expanded gas stream 79 at −225° F. This cold gas is used to liquefy the feed gas in heat exchanger pass 52. The second expanded gas stream 79 is mixed with the first expanded nitrogen stream 27 in heat exchanger pass 54, which provides additional chilling. Downstream of exchanger pass 54, the so warmed mixed stream 32 is compressed in compressor 58 forming stream 33, which is further compressed in compressor 59. This two step gas expander cycle is very efficient in achieving natural gas liquefaction as can be taken from the close temperature approaches of the heat composite curves between the feed gas and the refrigeration circuit as illustrated in FIG. 2.

During conventional LNG truck loading operation, LNG is typically pumped using LNG pumps from the storage tank to the LNG trucks. This operation requires at least 2 hours time, as the LNG truck must be chilled from typically ambient temperature to cryogenic temperature. This operation also generates a significant amount of boil off vapors, which are in most cases vented to atmosphere and so present a substantial environmental concern.

In contrast, and as is shown in FIG. 1, LNG is transferred from the LNG storage tank 65 to LNG truck 67 via streams 5, 6, and loading hose 66 by pressure differential, thereby allowing filling operation without the use of an LNG pump. LNG is transferred from a top outlet nozzle 98 using an internal pipe 99 inside the storage tank. This configuration avoids any bottom nozzles from the storage tank thus avoiding spillage of the storage tank inventory typically encountered in conventional storage tank design. Consequently, LNG pumps are not required. Flow controller 82 can be adjusted as necessary to deliver the flow quantity to the LNG truck. When the level in the storage tank drops to a low level, the level control 97 will stop flow in stream 5 at predetermined low level. Typically, the LNG storage tank 65 is configured with 30,000 gallons capacity, which is sufficient to load at least two LNG trucks, each with 10,000 gallons capacity. During LNG truck loading operation, valve 70 is closed, and valve 69 is open, allowing boil off vapor stream 7 to be vented from the truck to the cold box 51 as stream 9. Valve 69 controls the LNG truck vapor header at about 50 psig using the pressure controller 81, the lower pressure set-point of the LNG truck. With these valves operating in tandem, the boil off vapors during loading are recovered and venting to atmosphere is avoided.

In order to provide the driving force to pressurize the LNG inventory from storage to the LNG truck, valve 84 is open providing high pressure gas 85 to the storage tank. Pressure differential controller 88 and pressure controller 83 are used to control the required flow rate. Typically, the differential can be set at 10 psi or higher pressure depending on the distance between the storage tank and the truck, and the LNG loading rate can be varied from 250 GPM to 500 GPM using flow controller 82. If necessary the differential pressure can be increased to increase the loading rate. Therefore, it should be appreciated that LNG pumping is not necessary, and that the loading system size and cost can be significantly reduced.

While contemplated methods and plants presented herein may be have any capacity, it should be appreciated that such plants and methods are especially suitable for a small scale LNG plant having capacity of typically between 10 to 200 tons, more typically between 20-80 tons, and most typically between 30 to 60 tons of LNG production per day by liquefaction of appropriate quantities of feed gas. Consequently, contemplated plants and methods may be implemented at any location where substantial quantities of natural gas are available, and especially preferred locations include gas producing wells, gasification plants (e.g., coal and other carbonaceous materials), and at decentralized locations using gas from a natural gas pipeline. Thus, it should be recognized that the feed gas composition may vary considerably, and that depending on the type of gas composition, one or more pre-treatment units may be required. For example, suitable pre-treatment units include dehydration units, acid gas removal units, etc.

It is further noted that use of a cold box with an inert gas is particularly preferred, especially where the liquefaction/filling station is in an urban environment. However, various other cryogenic devices are also deemed suitable, and alternative devices include those that use mixed hydrocarbon refrigerants. Moreover, and particularly where the storage tank has a somewhat larger capacity, it is contemplated that refrigeration content from the LNG may also be used to supplement refrigeration requirements.

With respect to the differential pressure controller (dPC), it is noted that the dPC is preferably implemented as control device with a CPU, and may therefore be configured as a suitably programmed personal computer or programmable logic controller. It is also generally preferred that the dPC is configured such that the dPC controls operation of control vales to thereby maintain a predetermined pressure differential between the storage tank and the tank in the LNG transport vessel using pressure sensors and valves as is well known in the art. For example, control may be achieved by regulating pressure and/or flow volume of compressed boil off vapor from the compressor outlet en route to the storage tank, by regulating pressure and/or flow volume of boil off vapor from the tank in the LNG transport vessel, and/or by regulating pressure and/or flow volume of LNG from the storage tank to the tank in the LNG transport vessel. Thus, in at least some embodiments, the differential pressure controller will be configured to allow liquefaction operation concurrent with filling operation of the LNG transporter. Therefore, feeding of the natural gas to the liquefaction unit is done in continuous manner. However, discontinuous feeding and liquefaction is also contemplated.

It should be noted that contrary to most known configurations, at least a portion of the boil off vapor from the storage tank and/or tank in the LNG transport vessel is not liquefied, but used as a motive fluid to move LNG from the storage tank to the tank in the LNG transport vessel. Consequently, the need for a LNG pump is eliminated. Moreover, it should be noted that the refrigeration content of the boil off vapor from the tank in the LNG transport vessel can be employed to supplement refrigeration requirements in the cold box. Thus, the boil off vapor is heated rather than cooled and reliquefied as known in most operations.

It is still further contemplated that the storage tank may be modified in a manner such that LNG for export from the storage tank is drawn from a lower portion of the storage tank (e.g., sump or other location, typically below the center of gravity of the tank) through the vapor space of the tank to the filling line/loading hose, thereby avoiding problems associated with filling ports at the lower portion of the storage tank. Most typically, the tank will include an internal fill pipe that terminates at an upper portion of the tank to so allow connecting the internal fill pipe to a filling line/loading hose.

Thus, specific embodiments and applications of small scale LNG production and filling have been disclosed. It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A small scale LNG plant with integrated loading terminal, comprising:

a refrigeration unit comprising a closed refrigeration cycle, wherein the refrigeration unit is configured to provide refrigeration content to a natural gas feed in an amount sufficient to produce LNG from the natural gas feed in a cold box;

a LNG storage tank fluidly coupled to the cold box, wherein the LNG storage tank is configured to receive and store the LNG;

a first boil off vapor conduit configured to provide a first boil off vapor from an LNG transporter to the cold box, and to transfer the first boil off vapor from the cold box to the LNG storage tank to thereby allow use of the first boil off vapor as a motive force to move the LNG out of the LNG storage tank to the LNG transporter;

a second boil off vapor conduit configured to provide a second boil off vapor from the LNG storage tank to the cold box, and from the cold box to the natural gas feed; and a compressor that is configured to allow compression of at least one of the first boil off vapor or the second boil off vapor.

2. The plant of claim 1, further comprising a differential pressure controller configured to maintain a predetermined pressure differential between the LNG storage tank and the LNG transporter.

3. The plant claim 2, wherein the differential pressure controller is configured to allow liquefaction operation concurrent with filling operation of the LNG transporter.

4. The plant of claim 2, wherein the predetermined pressure differential is between 10-50 psi.

5. The plant of claim 1, wherein the refrigeration unit further comprises at least 3 exchanger passes configured to provide the natural as liquefaction refrigeration duty with a two stage nitrogen compression expander cycle.

6. The plant of claim 1, wherein the closed refrigeration cycle comprises a two stage turboexpander that is fluidly coupled with a two stage compression system, wherein the two stage turboexpander is configured to generate low level cooling, wherein the two stage compression system is configured to generate chilled gas feeding the turbo expanders while the power produced from the turbo expanders are used to reduce the gas compression energy requirement, and wherein the refrigeration cycle is configured to operate with a non-hydrocarbon refrigerant.

7. The plant of claim 1, wherein the refrigeration unit and storage tank are configured to provide an LNG production capacity of 10 to 200 tons per day.

8. The plant of claim 1, wherein the plant does not comprise a LNG pump configured to pass the LNG from the LNG storage tank to the LNG transport.

9. The plant of claim 5, wherein the refrigeration unit further comprises an exchange pass that is configured to recover refrigeration content from at least one of the first and second boil off vapors.

* * * * *